US005960774A

United States Patent [19]

Norgauer et al.

[11] Patent Number: 5,960,774

[45] Date of Patent: Oct. 5, 1999

[54] MOUNTING DEVICE FOR A FUEL INJECTION VALVE

[75] Inventors: Rainer Norgauer, Ludwigsburg; Christian Preussner, Markgröningen, both of Germany

[73] Assignee: Robert Bosch GmbH, Stuttgart, Germany

[21] Appl. No.: 09/171,040

[22] PCT Filed: Nov. 19, 1997

[86] PCT No.: PCT/DE97/02705

§ 371 Date: Oct. 9, 1998

§ 102(e) Date: Oct. 9, 1998

[87] PCT Pub. No.: WO98/36169

PCT Pub. Date: Aug. 20, 1998

[30] Foreign Application Priority Data

Feb. 17, 1997 [DE] Germany ..... 197 05 990

[51] Int. Cl.[6] ..... F02M 61/14

[52] U.S. Cl. ..... 123/470; 29/255

[58] Field of Search ..... 123/468, 469, 123/470; 29/255, 282

[56] References Cited

U.S. PATENT DOCUMENTS

| | | | |
|---|---|---|---|
| 2,909,210 | 10/1959 | Bennett | 29/255 |
| 4,110,886 | 9/1978 | Wendler et al. | 29/255 |
| 4,561,159 | 12/1985 | Schuster | 29/255 |
| 4,901,700 | 2/1990 | Knight et al. | 123/470 |
| 5,020,203 | 6/1991 | Rix | 29/255 |
| 5,566,658 | 10/1996 | Edwards et al. | 123/470 |
| 5,794,595 | 8/1998 | Berger et al. | 123/470 |

FOREIGN PATENT DOCUMENTS

| | | |
|---|---|---|
| 43 15 233 | 7/1994 | Germany . |
| 44 13 415 | 6/1995 | Germany . |

*Primary Examiner*—Thomas N. Moulis
*Attorney, Agent, or Firm*—Kenyon & Kenyon

[57] ABSTRACT

An installation device for installing a fuel injection valve in a receiving bore of a cylinder head of an internal combustion engine. The installation device has a sheath element which at least partially encloses the fuel injection valve. The installation device can be introduced, together with the fuel injection valve, into the receiving bore. An inwardly angled first collar section, which can be nonpositively joined to a receiving section of the fuel injection valve receiving the first collar section in order to transfer both a pressing force serving to press the fuel injection valve into the receiving bore and a pulling force in the opposite direction, is provided on a first end of the sheath element. An outwardly angled second collar section, which offers an application surface for a tool for applying both the pressing force and the pulling force, is shaped onto a second end of the sheath element located opposite to the first end.

10 Claims, 2 Drawing Sheets

2
20
42
12a
43
4
11
12b
5
1
26
3
44
41
21
25
40
7
23
22
24

MOUNTING DEVICE FOR A FUEL INJECTION VALVE

BACKGROUND INFORMATION

The present invention concerns an installation device for installing a fuel injection valve, in particular a high-pressure direct injection valve, in a receiving bore of a cylinder head of an internal combustion engine. Through the high-pressure direct injection valve, fuel is injected directly into the combustion chamber of the internal combustion engine.

German Published Patent Application No. 43,15,233 A1 describes a known installation device configured as a sealing sleeve for installation of a fuel injection valve on a direct-injection internal combustion engine. This known installation device surrounds the fuel injection valve over an axial portion and is pressed sealingly, by way of a clamping claw, onto the cylinder head. In this context, the known installation device configured as a sealing sleeve seals an oil chamber, which receives, inter alia, the camshafts and the cam followers for actuating the intake and exhaust valves, with respect to the fuel injection valve that is to be inserted into a receiving bore of the cylinder head. The known installation device is not itself introduced into the receiving bore for the fuel injection valve, but rather the known installation device forms an axial elongation of the receiving bore which extends to a cylinder head cover that closes off the oil chamber. The known installation device, which performs primarily a sealing function, is therefore of only limited suitability for pressing the fuel injection valve into the pertinent receiving bore of the cylinder head. In no way is the known installation device suitable for removing the fuel injection valve from the receiving bore, as is necessary for repair and maintenance, since with the known installation device it is not possible to transfer to the fuel injection valve any pulling force acting in the removal direction.

German Patent No. 44,13,415 C1 describes a further installation device with which a fuel injection valve can be installed in a receiving bore of a cylinder head of an internal combustion engine. Lateral flattened areas are provided on the nozzle holder of the fuel injection valve that is to be installed, to form contact surfaces for a clamping claw. The fuel injection valve that is to be installed is pushed completely into the receiving bore of the cylinder head by tightening the clamping claw. With this known installation device as well, it is not possible to remove the fuel injection valve for repair and maintenance. Instead, after the clamping claw has been loosened and removed, the fuel injection valve must be pulled out of the receiving bore using a different suitable tool, which can cause damage to the fuel injection valve.

SUMMARY OF THE INVENTION

The installation device according to the present invention provides the advantage not only that the fuel injection valve can be pressed into the receiving bore of the cylinder head, but also, because the installation device according to the present invention allows the application of pulling force, that the fuel injection valve can be pulled out of the receiving bore of the cylinder head for repair and maintenance purposes.

Because the installation device according to the present invention can be introduced together with the fuel injection valve into the receiving bore of the cylinder head, axial guidance of the installation device by the receiving bore is guaranteed. A first collar section provided at a first end of the installation device according to the present invention is used for nonpositive connection with the fuel injection valve, while a second collar section provided at the opposite end offers an application surface for a tool with which the installation device can be acted upon by both a pressing and a pulling force. In this context, the pressing or pulling force advantageously acts on a section of the fuel injection valve located relatively low down in the receiving bore, so that pressing or pulling loads on the relatively sensitive section of the fuel injection valve at the inflow end are avoided.

The fact that a sheath element at least partially surrounds the fuel injection valve results in particularly good protection of the fuel injection valve during pressing into the receiving bore of the cylinder head. The installation device according to the present invention thus makes possible particularly easy and low-stress installation and removal of the fuel injection valve in and from the cylinder head. With the installation device according to the present invention, installation can also be performed automatically or semiautomatically, thus considerably reducing installation costs.

A further advantage of the present invention may be seen in the fact that the fuel injection valve can be inserted into the installation device in a particularly simple and convenient manner if the installation device has a corresponding lateral recess. The first annular section can advantageously be fork-shaped and can enclose the receiving section, preferably configured as an annular groove, of the fuel injection valve. In addition, inwardly extending projections can advantageously be provided on the sheath element, in order additionally to secure the region of the fuel injection valve which is at the inflow end with respect to the receiving section.

In particularly advantageous fashion, the installation device according to the present invention can be manufactured integrally from a metal sheet, preferably by deep drawing. In addition, securing elements configured, for example, as clips can advantageously be attached in snap-locking fashion to the sheath element of the installation device, so that electrical supply lines to the fuel injection valve can be secured to the sheath element. In particularly advantageous fashion, the installation device according to the present invention can furthermore have hydraulic and/or electrical plug connections for easier connection to the electrical supply lines and the fuel supply line.

DETAILED DESCRIPTION

Figure 1:
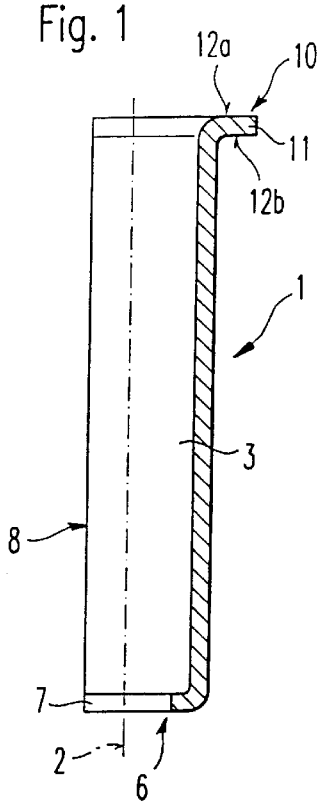
FIG. 1 shows an axial section through an installation device according to a first embodiment of the present invention.

The exemplary embodiment of an installation device 1 according to the present invention depicted in section in FIG. 1 has a sheath element 3, curved about a longitudinal axis 2, which is substantially of partially cylindrical shape. At a first end 6 which can be introduced into a receiving bore 4 (visible in FIG. 3) of a cylinder head 5 of an internal combustion engine, installation device 1 according to the present invention has a first collar section 7. As is evident from FIG. 2, which shows a top view of the exemplary embodiment of present installation device 1 depicted in FIG. 1, installation device 1 according to the present invention has a lateral recess 8, extending over the entire axial extension of installation device 1, by means of which a fuel injection valve 20 can be inserted into installation device 1. As is evident from FIG. 3, first collar section 7 receives a receiving section 25, configured in suitable fashion (e.g. as an annular groove), of fuel injection valve 20. For this purpose, as is evident from FIG. 2, first collar section 7 can be shaped like a fork, by the fact that a collar section 7*a* of partially cylindrical shape, which in the exemplary embodiment is bent through 180 degrees, is adjoined on either side by a straight collar section 7*b* and 7*c*. Straight collar sections 7*b* and 7*c* can run parallel to one another. Alternatively, straight collar sections 7*b* and 7*c* can be oriented with respect to one another such that recess 8 tapers slightly opposite to introduction direction 9 of fuel injection valve 20, in order to surround fuel injection valve 20 in snap-lock fashion.

Figure 2:
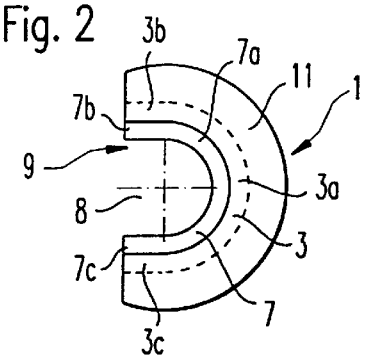
FIG. 2 shows a top view of the installation device according to the present invention depicted in FIG. 1.

As is evident from FIG. 2, sheath element 3 is correspondingly bent, in a partially cylindrically shaped sheath section 3*a,* through 180 degrees in the exemplary embodiment, sheath section 3*a* of partially cylindrical shape being adjoined on either side by a straight sheath section 3*b* and 3*c*.

As is evident from FIG. 1, a second collar section 11 is provided at end 10, located opposite first end 6, of installation device 1 according to the invention. Second collar section 11 offers, for a tool (not depicted), both an application surface 12*a* to be acted upon by a pressing force to press fuel injection valve 20 into receiving bore 4 of cylinder head 5, and a further application surface 12*b* to be acted upon by a pulling force, acting on the opposite direction, which is required for removal of fuel injection valve 1. In the preferred exemplary embodiment that is depicted, installation device 1 is manufactured from a metal strip by deep drawing. In the manufacturing operation, first the sheath element 3 is shaped in the manner apparent from FIGS. 1 and 2, and then first collar section 7 is bent inward so that it extends perpendicular to longitudinal axis 2. Second collar section 11 is correspondingly bent outward so that it also extends perpendicular to longitudinal axis 2.

Figure 3:
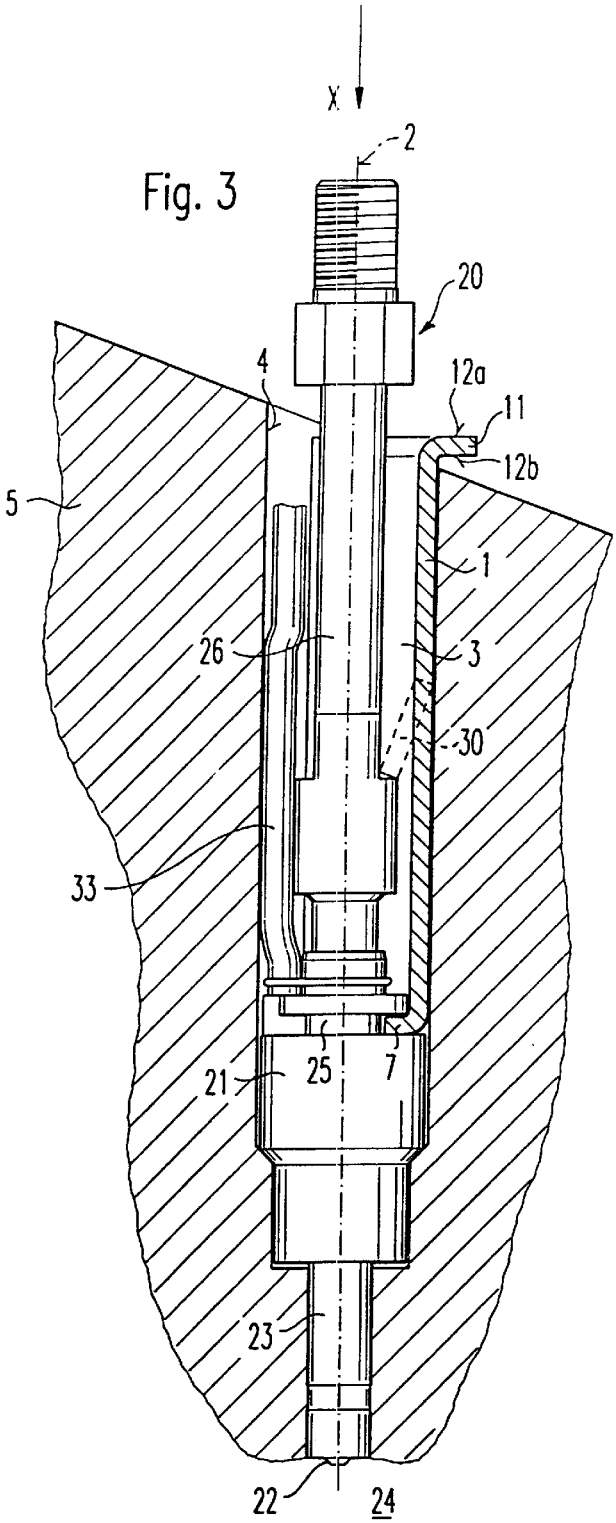
FIG. 3 shows an axial section through the cylinder head of an internal combustion and an installation device of the first embodiment according to the present invention that is introduced into a receiving bore of the cylinder head and guides a fuel injection valve.

FIG. 3 shows a section through cylinder head 5 of an internal combustion engine (not depicted in further detail), into whose receiving bore 4 a fuel injection valve 20, fastened to installation device 1 which is also depicted in section, is pressed. Receiving bore 4 is configured as a stepped bore adapted to nozzle body 23 of fuel injection valve 20, spray opening 22 being arranged where receiving bore 4 opens into combustion chamber 24 of the internal combustion engine.

During installation, fuel injection valve 20 is first slid into lateral recess 8 of installation device 1 according to the present invention in such a way that fuel injection valve 20 is secured to a receiving section, configured in the exemplary embodiment as annular groove 25, on first collar section 7 of installation device 1, for example upstream from nozzle holder 21. When fuel injection valve 20 is pressed into receiving bore 4 of cylinder head 5, fuel injection valve 20 is introduced into receiving bore 4 together with installation device 1 according to the present invention, and pressed into receiving bore 4 using a tool (not depicted) which acts on application surface 12*a* of second collar section 11. A clamping claw, for example, is suitable as the tool. It is essential in this context that the pressing force acting on application surface 12*a* of second collar section 11 be transferred in the X direction (see arrow X in FIG. 3), via installation device 1 according to the present invention, to receiving section 25 of fuel injection valve 20, without allowing the pressing force to act on region 26 of fuel injection valve 20 that is upstream from receiving section 25. In the case of installation device 1 that is shown in FIG. 3 and is pressed completely into receiving bore 4 together with fuel injection valve 20, second collar section 11 projects completely out of receiving bore 4, so that the tool can engage directly on second collar section 11 without the interposition of additional means.

Correspondingly, in the event of a removal of fuel injection valve 20 for repair or maintenance, a pulling force exerted with a suitable tool opposite to the X direction can be applied to application surface 12*b,* the pulling force being transferred, via installation device 1 according to the present invention, to receiving section 25 of fuel injection valve 20. During the removal of fuel injection valve 20, region 26 upstream from receiving section 25 is therefore once again not subjected to the pulling force necessary for removal.

In accordance with a development according to the present invention, inwardly extending lobe-like projections 30, drawn with dashed lines in FIG. 3, can be provided on sheath element 3 in order to secure fuel injection valve 20 additionally to installation device 1, by the fact that projections 30 rest, for example, against steps of the valve body. Lobe-like projections 30 can easily be punched out of installation device 1, which is preferably manufactured from a metal sheet, and then bent inward.

Figure 4:
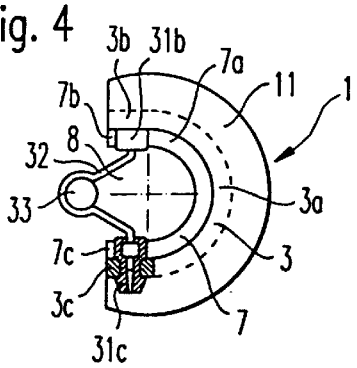
FIG. 4 shows a top view of an installation device according to the present invention as depicted in FIG. 2 and a view of securing elements for securing an electrical supply line.

FIG. 4 shows a top view, corresponding to FIG. 2, of installation device 1 according to the present invention. Elements already explained with reference to FIG. 1 or FIG. 2 are given conforming reference characters. According to a development, snap elements 31*b* and 31*c* which serve to receive one or more securing elements 32 are configured on straight sheath sections 3*b* and 3*c*. In the exemplary embodiment, securing elements 32 are configured in a bracket shape, surround an electrical supply line 33 that is more easily visible in FIG. 3, and snap into snap-lock elements 31*b* and 31*c*. A plurality of securing elements 32, which are offset axially along longitudinal axis 2 and secure electrical supply line 33 at multiple points to sheath element 3, can be provided. Securing elements 32 can also be configured to receive multiple electrical or other supply lines. Securing elements 32 prevent damage to electrical supply line 33 during the installation and removal of fuel injection valve 20.

According to a further development that is not depicted, the functions of the electrical connection and of a hydraulic connection for delivering fuel can also be integrated into installation device 1. For example, one hydraulic and one electrical plug connection may be envisaged, immovably joined to installation device 1 according to the present invention. When installation device 1 is introduced, these plug connections snap laterally into fuel injection valve 20, and terminate outside receiving bore 4 of cylinder head 5 for further connection to a wiring harness or a fuel delivery line.

Figure 5:
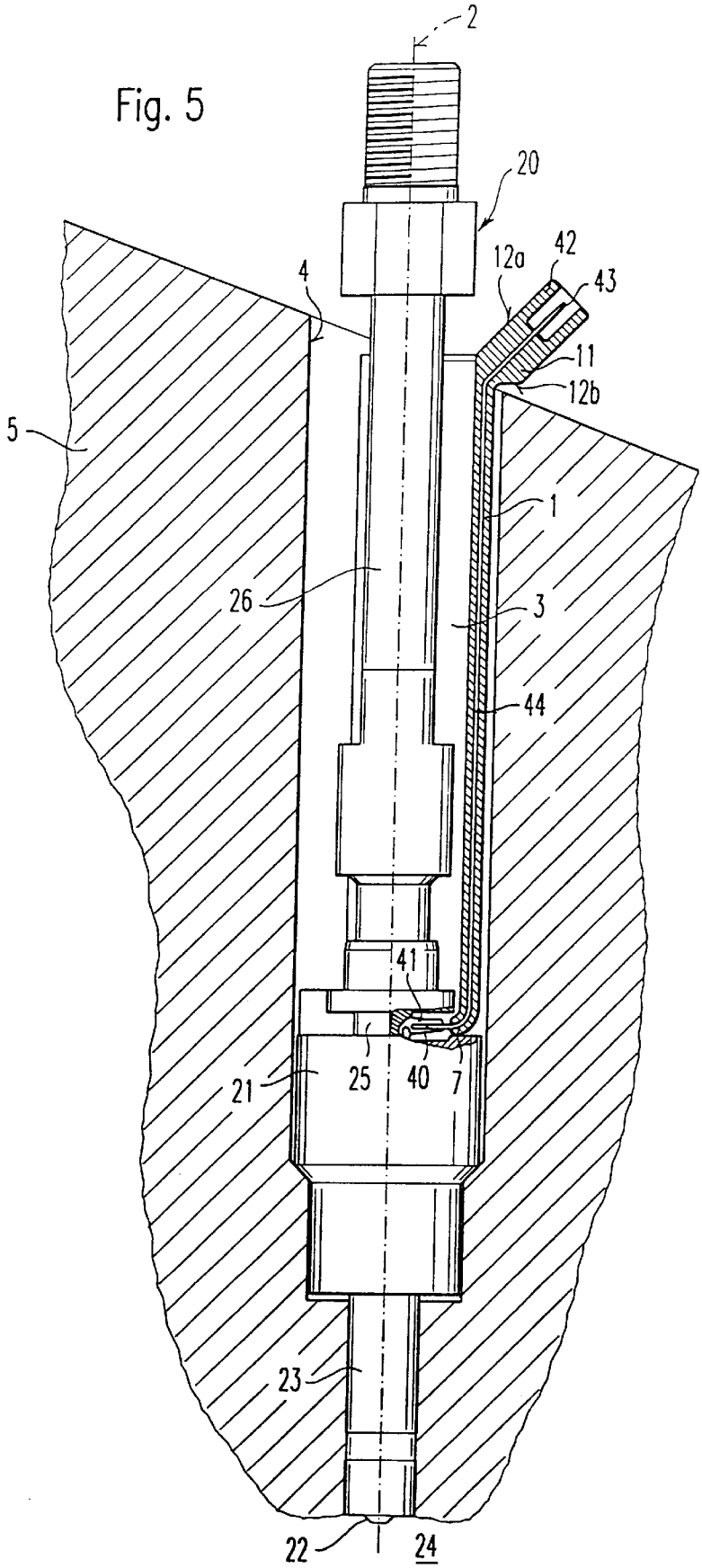
FIG. 5 shows an axial section through the cylinder head of an internal combustion engine and an installation device according to a second embodiment of the present invention introduced into a receiving bore.

A concrete exemplary embodiment of an installation device 1 according to the present invention equipped with an electrical plug connection is depicted in FIG. 5. FIG. 5 shows, in a manner similar to FIG. 3, a section through a cylinder head 5 of an internal combustion engine (not depicted in further detail), into whose receiving bore 4 a fuel injection valve 20, secured to installation device 1 that is also depicted in section, is pressed. In this exemplary embodiment as well, receiving bore 4 is configured as a stepped bore adapted to nozzle body 23 of fuel injection valve 20. Spray opening 22 is arranged where receiving bore 4 opens into combustion chamber 24 of the internal combustion engine.

As a development according to the present invention of the exemplary embodiment already described with reference to FIGS. 1 through 4, installation device 1 depicted in FIG. 5 has, in the region of its first collar section 7, radially inwardly projecting contact elements 40 which coact with corresponding mating elements 41 of fuel injection valve 20 for electrical contacting. Contact elements 40 can consist, for example, of radially projecting metal strips, while mating elements 41 of fuel injection valve 20 can be contact springs which enclose contact elements 40 in grasping fashion. Other electrical contacting capabilities known per se can, of course, also be used.

In the region of second collar section 11, installation device 1 depicted in FIG. 5 has a contact plug 42 which coacts with a contact bushing (not depicted). Contact pins 43 are provided on contact plug 42. Each of contact pins 43 is connected via a conductive element 44 to one of contact elements 40. Conductive elements 44 can, for example, be contact lugs manufactured from a metal strip, which are injection-molded onto a suitable plastic for electrical insulation with respect to installation device 1. Contact plug 42 can also be insert-molded onto installation device 1 according to the present invention using a plastic injection molding process. If installation device 1 is made from a metal, sheath element 3 which is insulated with respect to conductive elements 44 can at the same time be used to connect fuel injection valve 20 to ground. Conductive elements 44 either can run inside sheath element 3, or can be applied onto the inner or outer enveloping surface of sheath element 3.

Contact plug 42 is particularly easily accessible if contact pins 43 are angled, preferably at 45 degrees, with respect to longitudinal axis 2 of installation device 1.

What is claimed is:

1. An installation device for installing a fuel injection valve in a receiving bore of a cylinder head of an internal combustion engine, comprising:

a sheath element for transferring a pressing force to the fuel injection valve and partially enclosing the fuel injection valve, wherein the sheath element and the fuel injection valve are introduced into the receiving bore;

a first collar section shaped onto a first end of the sheath element and being nonpositively coupled to a receiving section of the fuel injection valve in order to transfer a pressing force serving to press the fuel injection valve along a first direction into the receiving bore and a pulling force serving to pull along a direction opposite to the first direction; and a second collar section shaped onto a second end of the sheath element located opposite to the first end and including at least one application surface for receiving the pressing force and the pulling force applied by a tool.

2. The installation device according to claim 1, wherein the sheath element includes a lateral recess running over an entire length of the sheath element and into which the fuel injection valve is introduced.

3. The installation device according to claim 1, wherein the first collar section is introduced into an annular groove serving as a receiving section of the fuel injection valve.

4. The installation device according to claim 3, wherein the first collar section is formed according to a shape of a fork that encloses the receiving section.

5. The installation device according to claim 1, wherein the sheath element includes at least one inwardly extending projection for providing an additional coupling between the sheath element and the fuel injection valve.

6. The installation device according to claim 1, wherein the installation device is manufactured integrally from a metal sheet according to a deep drawing operation.

7. The installation device according to claim 6, wherein:

the metal sheet is bent into a partial cylindrical shape, the metal sheet is bent inward at right angles with respect to a longitudinal axis of the sheath element at the first end of the sheath element in order to configure the first collar section, and the metal sheet is bent outward at right angles with respect to the longitudinal axis at the second end of the sheath element in order to configure the second collar section.

8. The installation device according to claim 1, further comprising at least one securing element coupled to the sheath element according to a snap-locking coupling in order to secure at least one supply line of the fuel injection valve to the sheath element.

9. The installation device according to claim 1, further comprising a plurality of plug connections, each of the plug connections including one of an hydraulic plug connection and an electrical plug connection and being coupled to a corresponding one of a plurality of mating elements of the fuel injection valve according to a snap-locking coupling when the fuel injection valve is installed on the installation device.

10. The installation device according to claim 9, further comprising:

in a region of the first collar section, a plurality of contact elements for coacting with the plurality of mating elements in order to provide an electrical contacting between the plurality of contact elements and the plurality of mating elements;

in a region of the second collar section, a contact plug; and a plurality of conductive elements running along one of an inside portion and an outside portion of the sheath element and coupling the contact plug to the plurality of contact elements.

* * * * *